US009534310B2

(12) United States Patent
Rauenbusch et al.

(10) Patent No.: US 9,534,310 B2
(45) Date of Patent: Jan. 3, 2017

(54) DEVICE FOR VERTICAL GALVANIC METAL, PREFERABLY COPPER, DEPOSITION ON A SUBSTRATE AND A CONTAINER SUITABLE FOR RECEIVING SUCH A DEVICE

(71) Applicant: Atotech Deutschland GmbH, Berlin (DE)

(72) Inventors: Ralph Rauenbusch, Burgthann (DE); Christian Thomas, Erlangen (DE); Ray Weinhold, Nürnberg (DE); Heinz Klingl, Neusäβ (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 14/649,003

(22) PCT Filed: Dec. 3, 2013

(86) PCT No.: PCT/EP2013/075411
§ 371 (c)(1),
(2) Date: Jun. 2, 2015

(87) PCT Pub. No.: WO2014/095355
PCT Pub. Date: Jun. 26, 2014

(65) Prior Publication Data

US 2015/0329985 A1 Nov. 19, 2015

(30) Foreign Application Priority Data

Dec. 20, 2012 (EP) ..... 12075143

(51) Int. Cl.
*C25D 17/00* (2006.01)
*C25D 17/12* (2006.01)
(Continued)

(52) U.S. Cl.
CPC ..... *C25D 17/001* (2013.01); *C25D 17/004* (2013.01); *C25D 17/06* (2013.01); *C25D 17/12* (2013.01); *C25D 5/08* (2013.01); *C25D 7/123* (2013.01)

(58) Field of Classification Search
CPC ..... C25D 5/026
See application file for complete search history.

(56) References Cited

U.S. PATENT DOCUMENTS 4,119,516 A * 10/1978 Yamaguchi ..... C25D 5/08 204/206
4,534,832 A * 8/1985 Doiron, Jr. ..... C25D 5/022 204/273

(Continued)

FOREIGN PATENT DOCUMENTS

GB 1266865 3/1972

OTHER PUBLICATIONS

PCT/EP2013/075411; PCT International Search Report and Written Opinion of the International Searching Authority dated Feb. 18, 2014.

(Continued)

*Primary Examiner* — Harry D Wilkins, III
(74) *Attorney, Agent, or Firm* — Renner, Otto, Boisselle & Sklar, LLP

(57) ABSTRACT

The present invention is related to a device for vertical galvanic metal, preferably copper, deposition on a substrate, a container suitable for receiving such a device and a substrate holder, which is suitable for receiving a substrate to be treated, and the use of such a device inside of such a container for galvanic metal, in particular copper, deposition on a substrate.

16 Claims, 5 Drawing Sheets

(51) Int. Cl.

| | |
|---|---|
| ***C25D 17/06*** | (2006.01) |
| ***C25D 7/12*** | (2006.01) |
| ***C25D 5/08*** | (2006.01) |

(56) References Cited

U.S. PATENT DOCUMENTS

| | | | | | |
|---|---|---|---|---|---|
| 4,853,099 | A | * | 8/1989 | Smith | C25D 5/026 204/224 R |
| 4,931,150 | A | * | 6/1990 | Smith | C25D 5/026 205/118 |
| 5,002,649 | A | * | 3/1991 | Smith | C25D 5/026 156/345.18 |
| 5,421,987 | A | * | 6/1995 | Tzanavaras | C25D 5/08 204/212 |
| 5,516,412 | A | | 5/1996 | Andricacos et al. | |
| 5,837,399 | A | * | 11/1998 | Oswald | H01M 2/30 429/101 |
| 5,976,329 | A | * | 11/1999 | Bock | C25D 1/10 204/212 |
| 2005/0056538 | A1 | | 3/2005 | Kovarsky et al. | |
| 2005/0247556 | A1 | | 11/2005 | Henry et al. | |
| 2006/0049038 | A1 | | 3/2006 | Griego et al. | |
| 2006/0110536 | A1 | | 5/2006 | Keigler et al. | |

OTHER PUBLICATIONS

PCT/EP2013/075411; PCT International Preliminary Report on Patentability mailed Mar. 13, 2015.

* cited by examiner

DEVICE FOR VERTICAL GALVANIC METAL, PREFERABLY COPPER, DEPOSITION ON A SUBSTRATE AND A CONTAINER SUITABLE FOR RECEIVING SUCH A DEVICE

The present application is a U.S. National Stage Application based on and claiming benefit and priority under 35 U.S.C. §371 of International Application No. PCT/EP2013/075411, filed 3 Dec. 2013, which in turn claims benefit of and priority to European Application No. 12075143.3 filed 20 Dec. 2012, the entirety of both of which is hereby incorporated herein by reference.

FIELD OF THE INVENTION

The present invention relates to a device for vertical galvanic metal, preferably copper, deposition on a substrate.

The present invention is further generally directed to a container suitable for receiving such a device and a substrate holder, which is suitable for receiving a substrate to be treated. Additionally, the present invention is related to the use of at least one such device inside of such a container for galvanic metal, in particular copper, deposition on a substrate.

BACKGROUND OF THE INVENTION

Production of semi conductive integrated circuits and other semi conductive devices from semiconductor wafers typically requires formation of multiple metal layers on the wafer to electrically interconnect the various devices of the integrated circuit. Electroplated metals typically include copper, nickel, gold and lead. Electroplating is effected by initial formation of a so-called seed layer on the wafer in the form of a very thin layer of metal, whereby the surface of the wafer is rendered electrically conductive. This electro conductivity permits subsequent formation of a so-called blanket layer of the desired metal by electroplating in a reactor vessel. Subsequent processing, such as chemical, mechanical planarization, removes unwanted portions of the metal blanket layer formed during electroplating, resulting in the desired patterned metal layer in a semiconductor integrated circuit or micro-mechanism being formed. Formation of a patterned metal layer can also be effected by electroplating.

Subsequent to electroplating, the typical semiconductor wafer or other work piece is subdivided into a number of individual semiconductor components. In order to achieve the desired formation of circuitry within each component, while achieving the desired uniformity of plating from one component to the next, it is desirable to form each metal layer to a thickness which is as uniform as possible across the surface of the work piece. However, because each work piece is typically joined at the peripheral portion thereof in the circuit of the electroplating apparatus (with the work piece typically functioning as the cathode), variations in current density across the surface of the work piece are inevitable. In the past, efforts to promote uniformity of metal deposition have included flow-controlling devices, such as diffusers and the like, positioned within the electroplating reactor vessel in order to direct and control the flow of electroplating solution against the work piece.

In a typical electroplating apparatus, an anode of the apparatus (either consumable or non-consumable) is immersed in the electroplating solution within the reactor vessel of the apparatus for creating the desired electrical potential at the surface of the work piece for effecting metal deposition. Previously employed anodes have typically been generally disk-like in configuration, with electroplating solution directed about the periphery of the anode, and through a perforate diffuser plate positioned generally above, and in spaced relationship to, the anode. The electroplating solution flows through the diffuser plate, and against the associated work piece held in position above the diffuser. Uniformity of metal deposition is promoted by rotatable driving the work piece as metal is deposited on its surface.

However, there is still a high demand in the market to provide amended devices and methods using such new amended devices for the galvanic metal deposition, in particular for the vertical galvanic metal deposition.

In particular, system maintenance, replacements and services require commonly, making use of devices known in the prior art, a high amount of manpower, while it is at the same time very time consuming, which makes the whole process inefficient and costly. Such work leads to a build-down of the entire device for galvanic metal deposition in order to be able to replace essential system components, such as anodes. Thus, during these time-periods, which comprise normally at least one working day, the entire device has to be stopped.

OBJECTIVE OF THE PRESENT INVENTION

In view of the prior art, it was thus a first object of the present invention to provide a device for vertical galvanic metal deposition on a substrate, which shall not exhibit the aforementioned shortcomings of the known prior art devices, in particular to provide a device which is suitable to form an advantageous composite unit together with a for this purpose suitable kind of container.

Additionally, it is a second object of the invention to provide a kind of container which is not solely suitable to receive a device for vertical galvanic metal deposition on a substrate, but also to form an advantageous composite unit together with such a device, in particular amending the capabilities of the composite unit for the requirements of system maintenance, replacements and services.

SUMMARY OF THE INVENTION

These objects and also further objects which are not stated explicitly but are immediately derivable or discernible from the connections discussed herein by way of introduction are achieved by a device having all features of claim 1. Appropriate modifications of the inventive device are protected in dependent claims 2 to 8. Further, claim 9 comprises an inventive container suitable for receiving at least such an inventive device, whereas appropriate modifications of said inventive container are protected in dependent claims 10 to 14. Furthermore, claim 15 comprises the use of at least one such inventive device inside of such an inventive container for galvanic metal, in particular copper, deposition on a substrate.

The present invention accordingly provides a device for vertical galvanic metal, preferably copper, deposition on a substrate characterized in that the device comprises at least a first anode element having at least one through-going conduit, at least a first carrier element comprising at least one through-going conduit, at least a first fluid feeding element for leading a treating solution inside said at least first carrier element, at least a first fastening means and at least a first electrical connecting element; wherein said at least first anode element and said at least first carrier element are firmly connected to each other; and wherein said at least first fastening means for fixing the entire device detachable inside of a container suitable for receiving such a device and said at least first electrical connecting element for providing electrical current to the at least first anode element are arranged both on the backside of said at least first carrier element.

It is thus possible in an unforeseeable manner to provide a device of for vertical galvanic metal deposition on a substrate, which does not exhibit the aforementioned shortcomings of the known prior art devices, in particular to provide a device which is suitable to form an advantageous composite unit together with a for this purpose suitable kind of container.

Additionally, the present invention provides a container which is not solely suitable to receive a device for vertical galvanic metal deposition on a substrate, but also to form an advantageous composite unit together with such a device, in particular belonging to the capabilities of the composite unit for system maintenance, replacements and services.

BRIEF DESCRIPTION OF THE FIGURES

For a more complete understanding of the present invention, reference is made to the following Detailed Description of the Invention considered in conjunction with the accompanying figures, in which.

DETAILED DESCRIPTION OF THE INVENTION

Figure 1:
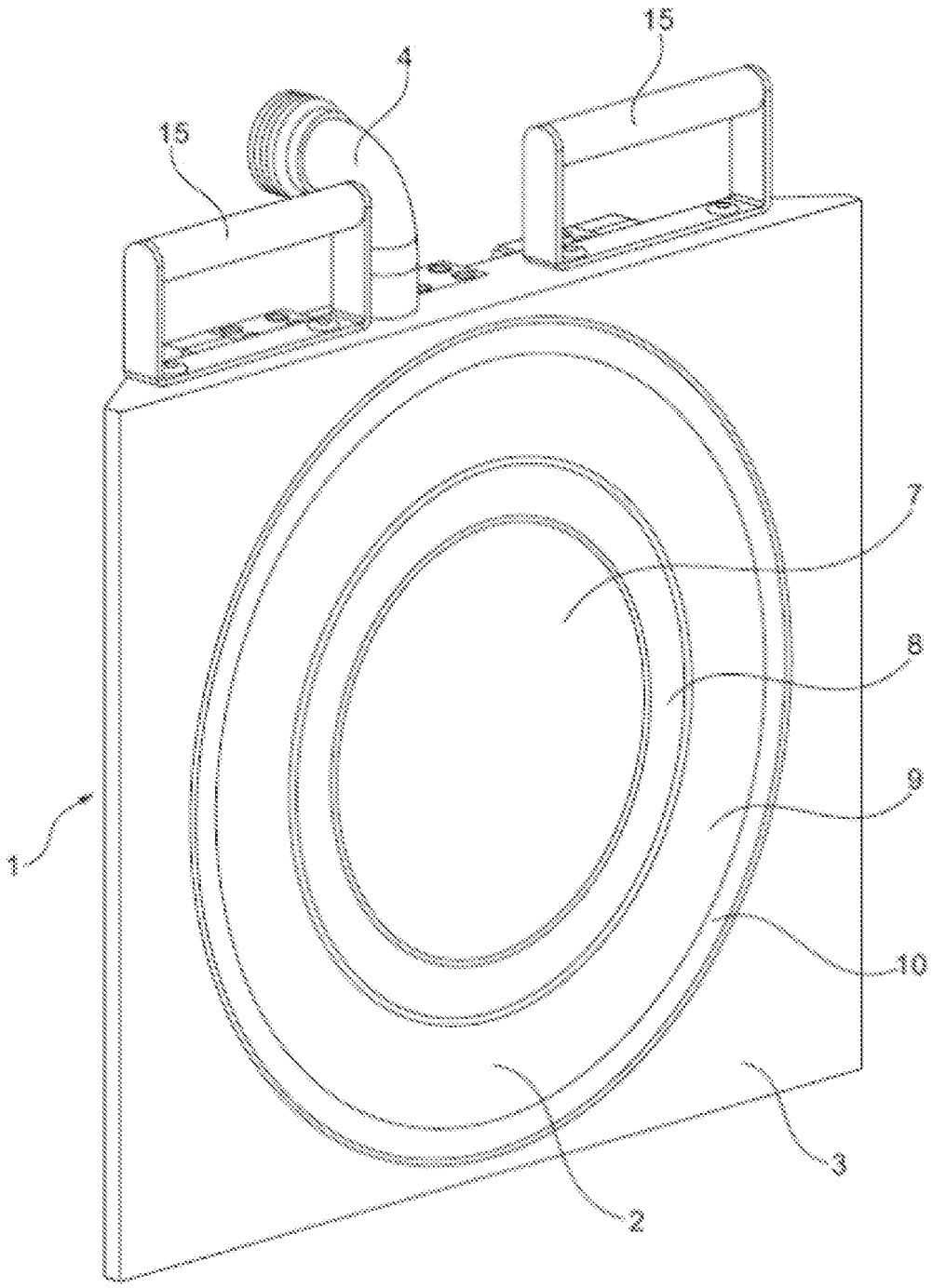
FIG. 1 shows a schematic perspective front view of a device of a preferred embodiment of the present invention.

As used herein, the term "galvanic metal", when applied to a device for vertical galvanic metal deposition on a substrate in accordance with the present invention, refers to metals which are known to be suitable for such a vertical deposition method. Such galvanic metals comprise gold, nickel, and copper, preferably copper.

It has to be noted that each through-going conduit of the at least first anode element has to be aligned with at least one respective through-going conduit of the at least first carrier element in order to allow a constant electrolyte volume flow to the substrate to be treated.

As used herein, the term "firmly connected" refers to a connection of the at least first carrier element and the at least first anode element lying in front of said carrier element without having any remarkable distance there between. Such a distance being not negligible would lead to a disadvantageous broadening of the electrolyte flow after having passed the through-going conduits of the carrier elements before reaching the respective through-going conduits of the first anode element.

It has been found advantageous, if such a distance between the firmly connected first carrier element and the first anode element is smaller than 50 mm, preferably smaller than 25 mm, and more preferably smaller than 10 mm.

As used herein, the term "backside" of the first carrier element refers to the opposite side of the first carrier element relating to the side of the first carrier element, wherein the first anode element is adapted to be arranged.

The present invention provides a device that ensures a constant volume flow speed of the treating solution wherein the volume flow speed is ranging from 0.1 to 30 m/s, preferable from 0.5 to 20 m/s, and more preferably from 1 to 10 m/s.

The overall thickness of the at least first carrier element is ranging from 4 mm to 25 mm, preferably from 6 mm to 18 mm, and more preferably from 8 mm to 12 mm; whereas the overall thickness of the at least first anode element is ranging from 1 mm to 20 mm, preferably from 2 mm to 10 mm, and more preferably from 3 mm to 5 mm.

In a preferred embodiment of the present invention, the through-going conduits of the at least first anode element and/or of the at least first carrier element can possess the same or different average diameters ranging from 0.2 mm to 10 mm, preferably from 1 mm to 8 mm, and more preferably from 2 mm to 5 mm.

In a preferred embodiment of the present invention, the through-going conduits of the at least first anode element and/or of the at least first carrier element can possess the same or different lengths.

It has been found advantageous in the present invention that the incoming flow of treating solution is going from an external source of treating solution, in particular from an at least one feeding means of treating solution, through the first fluid feeding element into the at least first carrier element. There, it has been found advantageous that the incoming flow of treating solution shall, if possible, reach the openings of the through-going conduits on the backside of the at least first carrier element all with the same, or at least with relatively similar, pressure to ensure a constant volume flow first through the through-going conduits of the at least first carrier element and second through the through-going conduits of the at least first anode element to reach the surface of the substrate to be treated having the same, or at least relatively similar, volume flow and volume flow speed.

In one embodiment, the device further comprises a second carrier element detachably connected to the at least first anode element, and preferably also to the at least first carrier element, wherein the at least first anode element, and preferably also the at least first carrier element, is, preferably are, at least partially, preferably completely, surrounded by said second carrier element, wherein the upper edges of the second carrier element and the first anode element are aligned or not, preferably aligned; and/or wherein said second carrier element is an at least partially, preferably completely, surrounding element arranged on the front surface of the at least first anode element, in particular a ring.

In a preferred embodiment, the second carrier element is a part of the first carrier element.

In one embodiment of the device, the at least first anode element is at least partially, preferably completely, surrounded by the at least first carrier element, wherein the side of said at least first carrier element directed towards said at least first anode element has a cavity to take said at least first anode element in such a way that the upper edges of the at least first carrier element and of the at least first anode element are aligned or not, preferably aligned.

Such a device offers a highly compact arrangement of the device based on the preferred alignment of the upper edges of the first carrier element and the first anode element. Thus, the first anode element is not a separated piece of the device spaced apart from the first carrier element as known in prior art, but it represents a uniform device unit leading to a smaller device saving cost, wherein the first anode element supports as well the stability of the whole device.

The alignment of the upper edges of the at least first carrier element and of the at least first anode element supports the above-cited limitation of the overall thickness of the at least first anode element due to the fact that the side of the at least first carrier element and of the at least first anode element opposite to the respective side of the substrate to be treated shall possess a uniform flat surface without any obstacles in form of height differences between the at least first carrier element and of the at least first anode element.

In one embodiment of the device, the first anode element and the first carrier element comprise a plurality of through-going conduits, which are respectively arranged on the respective surface of said first anode element or said first carrier element in form of concentric circles around the respective center of the first anode element or the first carrier element; and/or wherein the plurality of through-going conduits of the first anode element are going through the first anode element in form of straight lines having an angle relating to the perpendicular on the first anode element surface between 0° and 80°, preferably between 10° and 60°, and more preferably between 25° and 50°, or 0°; and/or wherein said through-going conduits comprise a round, preferably an elliptical, cross section, and/or the cross section of an oblong hole, preferably wherein the oblong holes have an orientation from the center to the outside of the first anode element; and/or wherein the plurality of through-going conduits of the first carrier element are going through the first carrier element in form of straight lines having an angle relating to the perpendicular on the carrier element surface between 10° and 60°, preferably between 25° and 50°; and/or wherein said through-going conduits comprise a round, preferably a circular, cross section.

In one embodiment of the device, the first anode element comprise at least two segments, wherein each anode element segment can be electrically controlled and/or regulated separately from each other; and/or wherein one first electrical connecting element provides current to at least one, preferably to exact one, anode segment by an at least second electrical connecting element connecting the first electrical connecting element(s) with the anode segment(s) of the anode element of the device, wherein the first electrical connecting element further comprise at least a first fastening element for fixing said first electrical connecting element detachable to the first carrier element of the device.

Herein, there can be a non-conductive layer and/or an intermediate spacing between these anode segments. In particular, the control and/or the regulation of the current can be advantageous in order to reduce the metal, in particular the copper, deposition at desired sites of the surface of the substrate to be treated.

In the present invention, it would be desirable to make use of so many second electrical connecting elements per anode segment as possible in order to homogenize the electrical field lines on the surface of the respective anode segments, which would provide in theory the best mode for generating an ideal electrical field. But, such a theoretical high number of second electrical connecting elements would lead to a maximized number of openings on the surface of the anode segments by which the risk of losing treating solution can be increased in a tremendous manner. Furthermore, there would be a tremendous loss of anode surface suitable for providing through-going conduits of the at least first anode element, thereby leading to worse results in galvanic metal deposition on a parallel arranged substrate to be treated. Conclusively, there has to be find a compromise between the requirements to generate a sufficient homogenized electrical field and providing at the same time a maximum of safety that no treating solution can be lost by leakages created by the openings of the second electrical connecting elements. Thus, the absolute minimum for the most interior lying anode segment is one second electrical connecting element arranged in the center of the anode segment; and two second electrical connecting elements for the other more exterior lying anode segments arranged opposite to each other.

In the present invention, one first electrical connecting element provides preferably current to exact one anode segment. It is technically possible to provide current to more than one anode segment by one first electrical connecting element. But this would require an additional intermediate electrical isolating layer inside of this one first electrical connecting element, which makes the system more complicated, more inefficient, and last but not least more costly than making use of exact one first electrical connecting element.

In one embodiment of the device, the at least first fastening means comprises at least a guiding element comprising a circular guide element or a linear guide element, such as a recess, a track, a guide bar and/or one part of a tongue and groove joint; and/or wherein said first fastening means further comprise at least a second fastening element for fixing said first fastening means detachable to the first carrier element of the device; and/or that the first fastening means and the first electrical connecting element form an at least first composite device element, wherein the first electrical connecting element functions additional as part of the first fastening means.

In particular, the use of such a first composite device element, wherein the first electrical connecting element functions additional as part of the first fastening means, offers the advantage that the number of required device elements necessary to solve the objective of the present invention can be further minimized which leads to an much easier way to monitor, control and/or regulate the device for galvanic metal deposition. Further, a minimized number of required device elements naturally save costs, working time and manpower.

In one embodiment, the device comprises one composite device element, preferably in the center of the backside of the first carrier element, or at least two composite device elements, wherein said composite device element(s) is/are arranged with or without additional first electrical connecting elements on the backside of the first carrier element of the device in dependence of the geometric structure of the anode segments of the anode element of the device, preferably wherein the at least two composite device elements are arranged in exterior areas of the backside of the first carrier element while additional first electrical connecting elements, if present, are arranged in the area between these at least two composite device elements of the backside of the first carrier element.

Such an arrangement offers advantages in the geometric stability of the device, which is suitable and provided to be received later on by a suitable kind of container.

In one embodiment, the device further comprise at least a first gripping element suitable for supporting a manual or automatic procedure to remove the device out of the container or to insert the device into the container, wherein said first gripping element is detachably or non-detachably connected to the device, preferably connected to the first carrier element.

Such a first gripping element can be any kind of mechanical device element suitable to support such a manual or automatic removing of the device out of a container. Preferably, the first gripping element can be a handle element and/or a hooking element.

Further, the second object of the present invention is solved by providing a container suitable for receiving at least one such device and at least a substrate holder suitable for receiving a substrate to be treated, wherein the at least first device and the at least first substrate holder are adapted to be arranged in a parallel manner respective to each other; wherein the container further comprises a closable ceiling, at least a second fastening means, at least a third electrical connecting element and at least a first sealing element; wherein said second fastening means and third electrical connecting element are arranged on at least one of the inside container walls for being detachably connected to the at least first fastening means and the at least first electrical connecting element on the backside of the inserted at least first device; wherein said first sealing element is provided for detachably connecting the at least first fluid feeding element of the at least first device with the container to prevent any leaking of treating solution; and wherein said closable ceiling can be opened to such an extent that the entire at least first device can be removed or inserted as complete unit.

It is thus possible in an unforeseeable manner to provide a container, which is not solely suitable to receive such a device for vertical galvanic metal deposition on a substrate, but also to form an advantageous composite unit together with such a device, in particular belonging to the capabilities of the composite unit for system maintenance, replacements and services.

The container of the present invention offers the possibility to easily insert and remove at least the entire first device without having any major obstacles besides opening the detachable connections of the at least first fluid feeding element with the container, opening the detachable connections of the second fastening means and the third electrical connecting elements with the respective at least first fastening means and the at least first electrical connecting element, and of course opening of the ceiling of the container itself.

In particular, the container of the present invention allows a tremendously amended system maintenance, replacement of consumed and/or defect materials, and services, which require commonly a high amount of manpower and time which makes it inefficient and costly. There is no more a build-down of the entire device for galvanic metal deposition necessary in order to be able to replace essential system components, such as anodes. Thus, during these time-periods, which comprise normally at least one working day, the entire device has no more to be interrupted and/or stopped.

Furthermore, such an inventive device arranged in such an inventive container serves still another purpose of the invention, namely that the overall size of the complete unit comprising at least one such device and such a container is much lower than commonly known prior art devices build up at a stationary place. Thus, in particular if the substrate to be treated is a wafer which requires costly clean room area, saves a tremendous part of costs compared to these known devices and systems due to the fact that the complete unit is simply much smaller.

Additionally, such a size reduced container requires much less quantities of chemical galvanic bath components in order to conduct a galvanic metal deposition process. This again reduces costs and required materials and resources, such as current.

In the present invention, the container can be a vessel, a box or generally any kind of room suitable for a galvanic metal, in particular copper, deposition process, wherein said container is closable for generating a defined treatment area, and/or wherein said container is movable or non-movable.

In a preferred embodiment, the container comprise the third electrical connecting elements and the second fastening means arranged on two opposite inside walls for being able to receive two such inventive devices allowing a galvanic metal, in particular copper, deposition on both sides of a substrate to be treated.

In the present invention, one third electrical connecting element provides preferably current to exact one anode segment. It is technically possible to provide current to more than one anode segment by one third electrical connecting element. But this would require an additional intermediate electrical isolating layer inside of this one third electrical connecting element, which makes the system more complicated, more inefficient, and last but not least more costly than making use of exact one third electrical connecting element.

In an embodiment, the ceiling of the container can be an angular ceiling or a flat ceiling, in particular movable in horizontal direction to open it.

The ceiling is in particular so advantageous because it allows not solely the insertion or removal of the substrate holder with a substrate to be treated, but also the entire device, which offers an easy capability for system maintenance and controlling.

In one embodiment, the at least first substrate to be treated is round, preferably circular, or angular, preferably polyangular, such as rectangular, quadratic or triangular, or a mixture of round and angular structure elements, such as semicircular; and/or wherein the at least first substrate to be treated has a diameter ranging from 50 mm to 1000 mm, preferably from 100 mm to 700 mm, and more preferably from 120 mm to 500 mm, in case of a round structure; or a side length ranging from 10 mm to 1000 mm, preferably from 25 mm to 700 mm, and more preferably from 50 mm to 500 mm, in case of an angular, preferably polyangular, structure and/or wherein the at least first substrate to be treated is a printed circuit board, a printed circuit foil, a semiconductor wafer, a solar cell, a photoelectric cell or a monitor cell.

It can be further intended by the present invention that the general shape of the at least first anode element and/or of the at least first carrier element of the first and/or third device element is orientated at the general shape of the substrate to be treated and/or of the substrate holder of the second device element. Hereby, the galvanic metal deposition can still be made more efficient and cost saving by reducing the required device construction conditions.

In a preferred embodiment of the container, the at least second fastening means provides the counter piece of the guiding element comprising a circular guide element or a linear guide element, such as a recess, a track, a guide bar and/or one part of a tongue and groove joint of the at least first fastening means of the at least first device.

In a preferred embodiment of the present invention, the at least second fastening means has to be an element which reduces the degree of freedom of the first fastening means of the device while being in conjunction with it in order to form a detachably connection between the first carrier element of the device and the container. In particular, the at least second fastening means shall be provided in such a way that there is no need for an additional setting up afterwards. The system shall be automatically set up, so that an user has solely to insert the device in the container, to close the detachably connections between the second fastening means and third electrical connecting element of the container and the first fastening means and the first electrical connecting elements of the device; and to close the detachably connection of the first fluid feeding element of the device and the container to be able to conduct a galvanic metal deposition process.

In a preferred embodiment, the device and the container offer the advantage that the anode segment geometry, such as the distances between the different anode segments, can be very flexible changed without generating major obstacles or time wasting for an user due to the fact that solely a change in the arrangement of the third electrical connecting elements of the container has to be made.

In another preferred embodiment of the container, the at least first electrical connecting element of such an inventive device and the third electrical connecting element of such an inventive container are detachably connected by at least a fourth electrical connecting element, such as screws or pins.

In one preferred embodiment, the electrical connecting elements of the device and of the container can be composed of at least one piece, in particular of at least two pieces, preferably spaced apart from each other if there are more than one piece.

In one embodiment of the present invention, the container further comprises at least a fifth electrical connecting element and at least a sixth electrical connecting element, wherein said fifth electrical connecting element is going from the third electrical connecting element through the container wall, wherein said fifth electrical connecting element is detachably connected to the outside wall of the container by an at least third fastening element; and wherein said sixth electrical connecting element is a plug in element and/or a bolted assembly for current cables.

This offers again a tremendous advantage compared to containers and devices known in the prior art, because there is a dry entry, outside of the treating solution fluid system inside of the container, for current cables to easily getting plugged in and out and/or generating a bolted assembly without that an user has to handle current cables inside of such an container. Thus, this avoids making use of expensive materials and isolating procedures for isolating of the current cables, which have been used before in the prior art inside of such containers.

The sixth electrical connecting element is preferably a quick connection element for inserting and/or removing current cables in a very efficient and fast way.

To ensure that no treating solution and/or any fluids from inside the container could possibly reach the area outside of the container, there is preferably provided a second sealing element to seal the fifth and/or sixth electrical connecting elements.

In another embodiment of the present invention, the second fastening means and the third electrical connecting element of the container form an at least second composite device element, wherein the third electrical connecting element functions additional as part of the second fastening means, if the first fastening means and the first electrical connecting element of the at least first device form an at least first composite device element, wherein the first electrical connecting element functions additional as part of the first fastening means.

In particular, the use of such a second composite device element, wherein the third electrical connecting element functions additional as part of the second fastening means, offers the advantage, preferably if used in conjunction with an at least first composite device element of the received device, that the number of required device elements necessary to solve the objective of the present invention can be further minimized which leads to an much easier way to monitor, control and/or regulate the device for galvanic metal deposition. Further, a minimized number of required device elements naturally save costs, working time and manpower.

In one embodiment of the present invention, the container is further suitable for receiving at least a second device of the present invention, which is adapted to be arranged in a parallel manner respective to the at least first device and the at least first substrate holder.

Additionally, by receiving such a second device, which can be identical or different in comparison to the first device, the container and the devices of the present invention are not solely suitable to deposit metal, in particular copper, on both sides of the substrates to be treated, but also to successfully and effectively execute bridge-building of galvanic metal in interconnecting holes of the substrate to be treated with subsequent filling of them without generating enclosed voids, gases, electrolytic liquids and alike.

Additionally, at least one, preferably two, such inventive device(s) inside of such an inventive container can be used for galvanic metal, in particular copper, deposition on a substrate, preferably for, in particular simultaneous, deposition on both sides of the substrate.

The present invention thus addresses the problem of minimizing the required space for a process of galvanic metal, in particular copper, deposition on a substrate to be treated while at the same time the costs can be further reduced and the inventive device and the inventive container serves an amended and more simplified way to make use of such devices and container by allowing less qualified, and therefore less expensive, people to overtake these purposes.

The following non-limiting examples are provided to illustrate a preferred embodiment of the present invention, wherein the first anode element of the device is completely surrounded by the first carrier element of the device, wherein the side of said first carrier element directed towards said first anode element has a cavity to take said first anode element in such a way that the upper edges of the first carrier element and of the first anode element are aligned. Said preferred embodiment shall facilitate the understanding of the invention, but are not intended to limit the scope of the invention, which is defined by the claims appended hereto.

Turning now to the Figures, FIG. 1 shows a schematic perspective front view of a device 1 of a preferred embodiment of the present invention comprising a first anode element 2, a first carrier element 3, a fluid feeding element 4 and a first gripping element 15. Further, the first anode element 2 is subdivided in a first, second, third and fourth anode segment 7, 8, 9, 10. In such a schematic front view of an inventive device 1 there is not shown the claimed at least one through-going conduit of the first anode element 2, wherein each anode segment 7, 8, 9, 10 can preferably have a plurality of said through-going conduits. Additionally, there is not shown any fastening or electrical connecting elements which are required to fasten the first anode element 2 to the first carrier element 3 and to be provided with electrical current, preferably for each anode segment 7, 8, 9, 10 separately.

Figure 2:
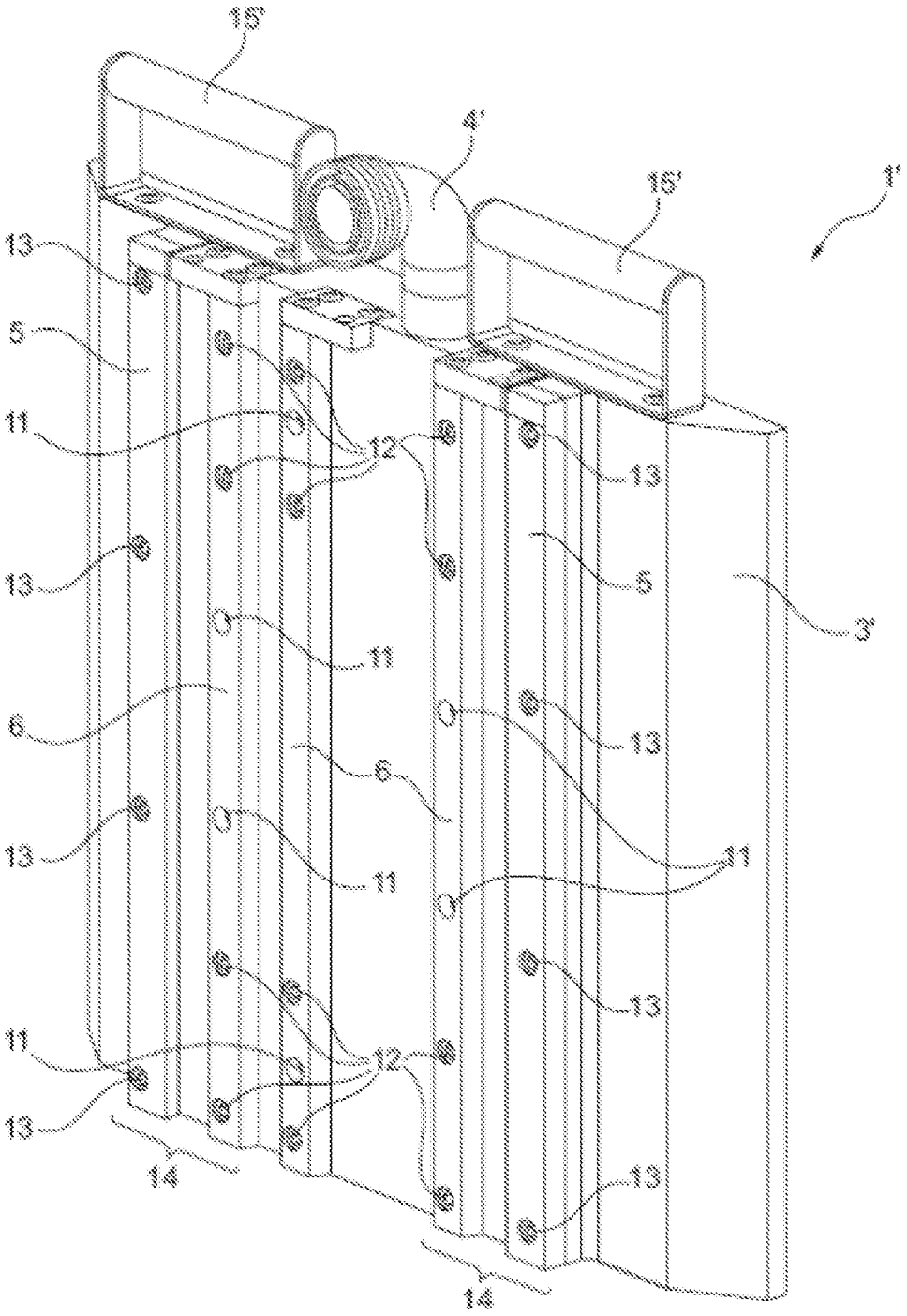
FIG. 2 shows a schematic perspective back view of a device of a preferred embodiment of the present invention.

FIG. 2 shows a schematic perspective back view of a device 1' of a preferred embodiment of the present invention comprising a first gripping element 15' and a fluid feeding element 4'. Furthermore, there are two first fastening means 5 provided, which are arranged at the outer areas of the backside of the first carrier element 3'. In this preferred embodiment of the present invention, these two first fastening means 5 are representing in conjunction with two of the three provided first electrical connecting elements 6 two first composite device elements 14. Hereby, each first fastening means 5 is fixed on the backside of the first carrier element 3' by four second fastening elements 13, respectively. In the middle between these two first composite device elements 14 there is a third first electrical connecting element 6 being identical to the other two ones. All three first electrical connecting elements 6 comprise four first fastening elements 12 and two second electrical connecting elements 11 wherein it is noteworthy that said two second electrical connecting elements 11 are arranged at different sites of the respective first electrical connecting element 6 in order to generate a sufficient homogenized electrical field for each anode segment on the front side of said device 1'.

Figure 3:
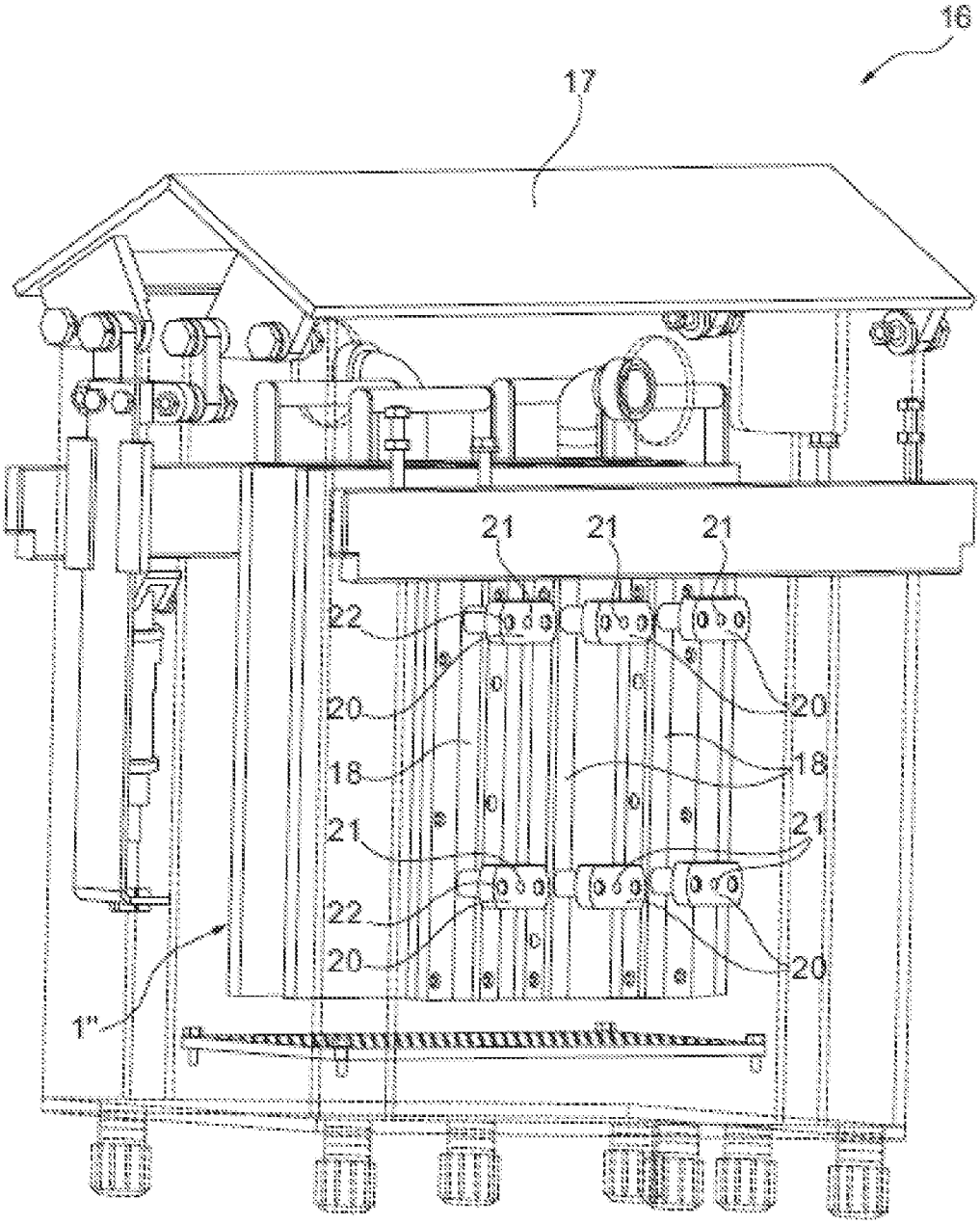
FIG. 3 shows a schematic view of a container comprising a received device of a preferred embodiment of the present invention.

FIG. 3 shows a schematic view of a container 16 comprising a received device 1" of a preferred embodiment of the present invention comprising a closable ceiling 17 to insert or remove at least one device 1". Three third electrical connecting elements 18 are shown, which shall forward the electrical current to the first electrical connecting elements (not shown or not good to see) of a received device 1', whereby again forwarding the electrical current further by the second electrical connecting elements (not shown) to the single anode segments of the first anode element of the device 1". But to conduct the electrical current to these three third electrical connecting elements 18 itself, the preferred embodiment of the present invention comprise further six fifth electrical connecting elements 20, which are each fixed on the outer side of the container 16 by two third fastening elements 22. These fifth electrical connecting elements 20 are going from the outer side of the container 16 to the third electrical connecting elements 18 inside of the container 16. Additionally, each fifth electrical connecting element 20 comprise a sixth electrical connecting element 21, which can be used as plug in for current cables, preferably provided as a quick connection element.

Figure 4:
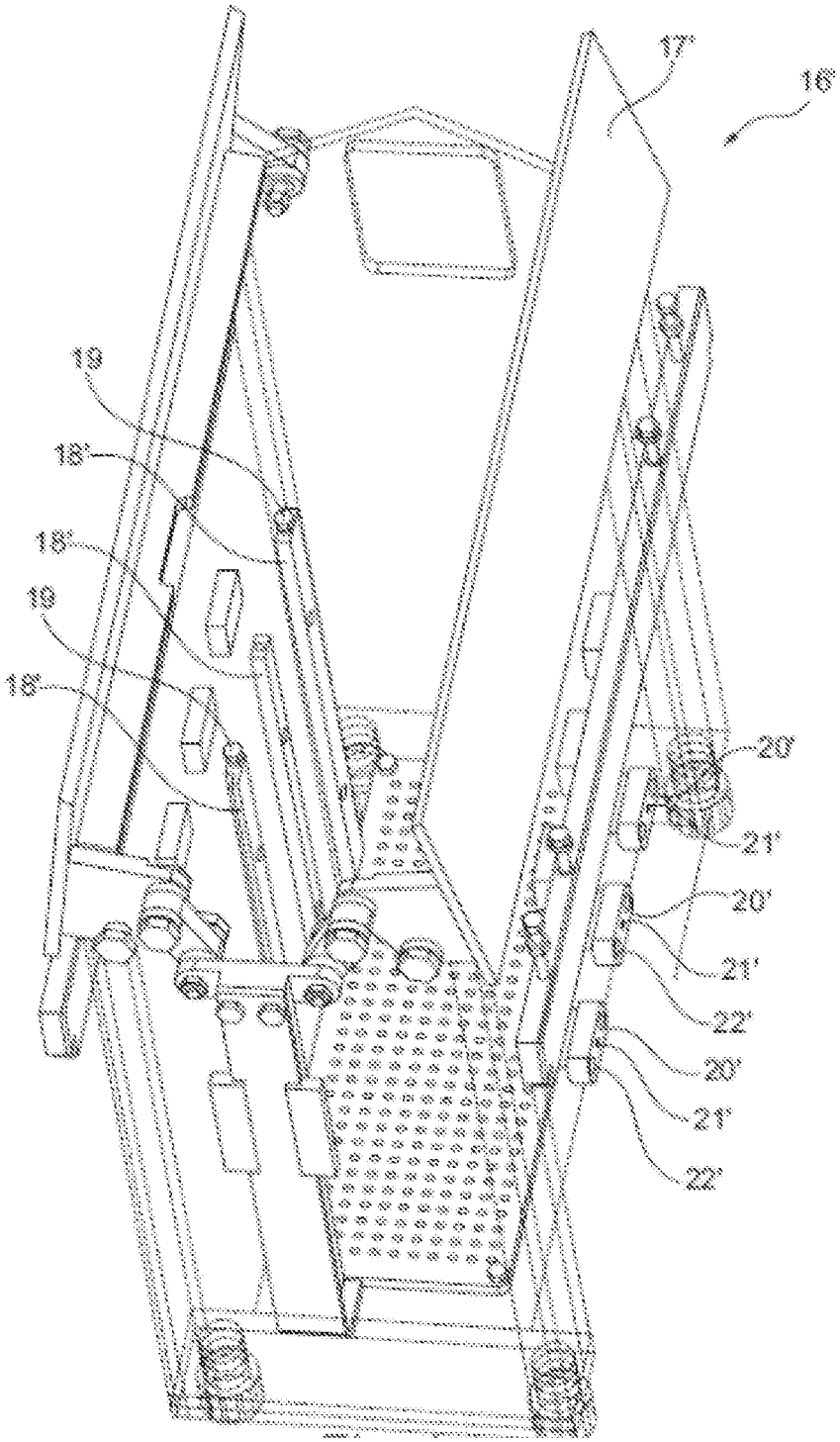
FIG. 4 shows a schematic perspective top view of a container suitable to receive a device of a preferred embodiment of the present invention.

FIG. 4 shows a schematic perspective top view of a container 16' suitable to receive a device of a preferred embodiment of the present invention comprising a closable ceiling 17' to insert or remove at least one device. Three third electrical connecting elements 18' are shown on the left inside wall of the container 16', which shall forward the electrical current to the first electrical connecting elements (not shown) of a suitable device to be received. The three third electrical connecting elements 18' comprise each a fourth electrical connecting element 19, which serves to close or to open the electrical contact to the respective third electrical connecting element 18'. The middle one of these three third electrical connecting elements 18' is shown for illustrative purposes without such a fourth electrical connecting element 19, but normally there will be one present. Furthermore, the container 16' comprises a plurality of fifth electrical connecting elements 20', which are fixed on the outer side of the container 16' by two third fastening elements 22'. These fifth electrical connecting elements 20' are going from the respective outer side of the container 16' to the third electrical connecting elements 18' on the respective inside wall of the container 16'.

There is solely shown in FIG. 4 for purposes of better illustration the fifth electrical connecting elements 20' on the right outside wall of the container 16' and the third electrical connecting elements 18' and fourth electrical connecting elements 19 on the left inside wall of the container 16', which are connected in the sense of the present invention to fifth electrical connecting elements 20' going inside the container 16' from the left outside of the container 16' (not shown) while the shown fifth electrical connecting elements 20' on the right outside wall of the container 16' are going from the right outside wall of the container 16' to the third electrical connecting elements 18' and fourth electrical connecting elements 19 on the right inside wall of the container 16' (not shown). Additionally, each fifth electrical connecting element 20' comprise a sixth electrical connecting element 21', which can be used as plug in for current cables, preferably provided as a quick connection element.

Figure 5:
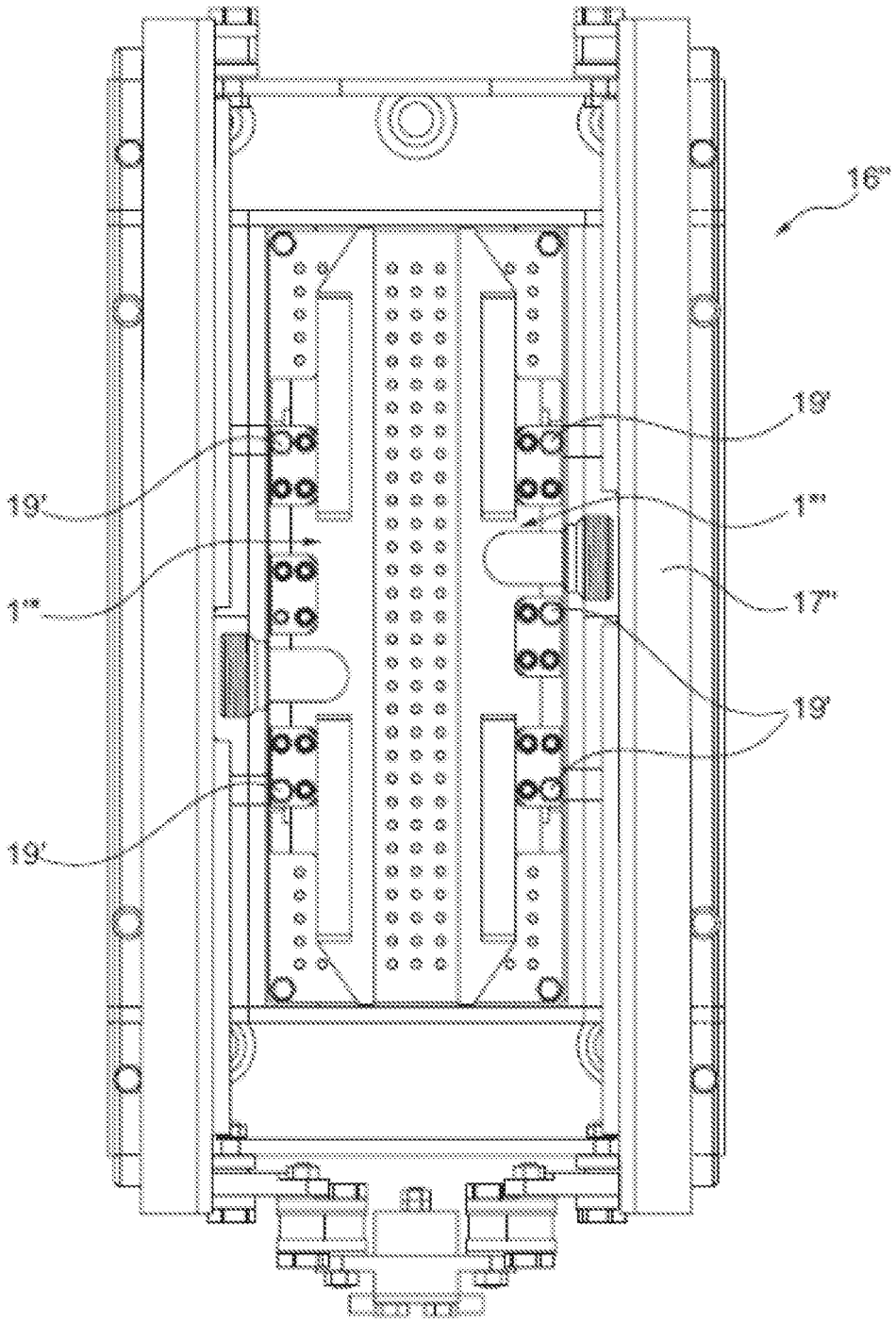
FIG. 5 shows a schematic top view of a container comprising a received device of a preferred embodiment of the present invention.

FIG. 5 shows a schematic top view of a container 16" comprising two received devices 1'" of a preferred embodiment of the present invention comprising a closable ceiling 17" to insert or remove at least one device. The container 16" shows clearly the plurality of fourth electrical connecting elements 19', which serves to close or to open the electrical contact to the respective third electrical connecting elements. The middle one of these three third electrical connecting elements on the left side is shown for illustrative purposes without such a fourth electrical connecting element 19', but normally there will be one.

It will be understood that the embodiments described herein are merely exemplary and that a person skilled in the art may make many variations and modifications without departing from the spirit and scope of the invention. All such variations and modifications, including those discussed above, are intended to be included within the scope of the invention as defined by the appended claims.

REFERENCE SIGNS

1, 1', 1", 1'" Device
2 First anode element
3, 3' First carrier element
4, 4' Fluid feeding element
5 First fastening means
6 First electrical connecting element
7, 8, 9, 10 First, second, third, fourth anode segment
11 Second electrical connecting element
12 First fastening element
13 Second fastening element
14 First composite device element
15, 15' First gripping element
16, 16', 16" Container
17, 17', 17" Closable ceiling
18, 18' Third electrical connecting element
19, 19' Fourth electrical connecting element
20, 20' Fifth electrical connecting element
21, 21' Sixth electrical connecting element
22, 22' Third fastening element

The invention claimed is:

1. A device for vertical galvanic metal deposition on a substrate wherein the device comprises at least a first anode element having at least one through-going conduit, at least a first carrier element comprising at least one through-going conduit, at least a first fluid feeding element for leading a treating solution inside said at least first carrier element, at least a first fastening means and at least a first electrical connecting element;

wherein said at least first anode element and said at least first carrier element are firmly connected to each other; and wherein said at least first fastening means for fixing the entire device detachable inside of a container suitable for receiving such a device and said at least first electrical connecting element for providing electrical current to the at least first anode element are arranged both on the backside of said at least first carrier element;

wherein the first anode element and the first carrier element comprise a plurality of through-going conduits, which are respectively arranged on the respective surface of said first anode element or said first carrier element in a form of concentric circles around the respective center of the first anode element or the first carrier element;

wherein the plurality of through-going conduits of the first anode element are going through the first anode element in a form of straight lines having an angle relating to the perpendicular on the first anode element surface between 0° and 80°; and wherein the plurality of through-going conduits of the first carrier element are going through the first carrier element in a form of straight lines having an angle relating to the perpendicular on the carrier element surface between 10° and 60°.

2. The device according to claim 1 wherein the at least first anode element is at least partially surrounded by the at least first carrier element, wherein the side of said at least first carrier element directed towards said at least first anode element has a cavity to receive said at least first anode element in such a way that the upper edges of the at least first carrier element and of the at least first anode element are aligned.

3. The device according to claim 1 wherein the first anode element comprises at least two segments, wherein each anode element segment can be electrically controlled separately from each other.

4. The device according to claim 3 wherein one of the at least one first electrical connecting element provides current to at least one anode segment by an at least second electrical connecting element connecting the first electrical connecting element with the anode segment of the anode element of the device, wherein the at least one first electrical connecting element further comprises at least a first fastening element for fixing said first electrical connecting element detachable to the first carrier element of the device.

5. The device according to claim 1 wherein the at least first fastening means comprises at least a guiding element comprising a circular guide element or a linear guide element.

6. The device according to claim 1 wherein the first fastening means further comprises at least a second fastening element for fixing the first fastening means detachably to the first carrier element of the device.

7. The device according to claim 1 wherein the first fastening means and the first electrical connecting element form an at least first composite device element, wherein the first electrical connecting element functions additionally as part of the first fastening means.

8. The device according to claim 1 wherein the device comprises at least two composite device elements, wherein the composite device elements are arranged with additional first electrical connecting elements on the backside of the first carrier element of the device in dependence of the geometric structure of the anode segments of the anode element of the device.

9. The device according to claim 8 wherein the at least two composite device elements are arranged in exterior areas of the backside of the first carrier element while additional first electrical connecting elements are arranged in the area between these at least two composite device elements of the backside of the first carrier element.

10. The device according to claim 1 wherein the device further comprises at least a first gripping element suitable for supporting a manual or automatic procedure to remove the device out of the container or to insert the device into the container, wherein said first gripping element is detachably connected to the first carrier element.

11. A system comprising a container and at least one device according to claim 1, wherein the container is suitable for receiving the at least one device and wherein the container comprises at least one substrate holder suitable for receiving a substrate to be treated, wherein the at least one device and the at least one substrate holder are adapted to be arranged in a parallel manner respective to each other;

wherein the container further comprises a closable ceiling, at least a second fastening means, at least a third electrical connecting element and at least a first sealing element;

wherein said second fastening means and third electrical connecting element are arranged on at least one of the inside container walls for being detachably connected to the at least first fastening means and the at least first electrical connecting element on the backside of the at least one device when the at least one device has been inserted in the container;

wherein said first sealing element is provided for detachably connecting the at least first fluid feeding element of the at least one device with the container to prevent any leaking of treating solution;

wherein said closable ceiling can be opened to such an extent that the entire at least one device can be removed or inserted as a complete unit; and wherein the at least second fastening means provides a counter piece of the at least first fastening means comprising a circular guide element or a linear guide element.

12. The system according to claim 11 wherein the at least first electrical connecting element of the at least one device and the third electrical connecting element of the container are detachably connected by at least a fourth electrical connecting element.

13. The system according to claim 11 wherein the container further comprises at least a fifth electrical connecting element and at least a sixth electrical connecting element, wherein said fifth electrical connecting element is going from the third electrical connecting element through the container wall, wherein said fifth electrical connecting element is detachably connected to the outside wall of the container by an at least third fastening element; and wherein said sixth electrical connecting element is a plug in element and/or a bolted assembly for current cables.

14. The system according to claim 12 wherein the container further comprises at least a fifth electrical connecting element and at least a sixth electrical connecting element, wherein said fifth electrical connecting element is going from the third electrical connecting element through the container wall, wherein said fifth electrical connecting element is detachably connected to the outside wall of the container by an at least third fastening element; and wherein said sixth electrical connecting element is a plug in element and/or a bolted assembly for current cables.

15. The system according to claim 11 wherein the second fastening means and the third electrical connecting element of the container form an at least second composite device element, wherein the third electrical connecting element functions additionally as part of the second fastening means, if the first fastening means and the first electrical connecting element of the at least one device form an at least first composite device element, wherein the first electrical connecting element functions additionally as part of the first fastening means.

16. The system according to claim 11 wherein the container is further suitable for receiving at least a second device, which is adapted to be arranged in a parallel manner respective to the at least one device and the at least first substrate holder.

* * * * *